US006789452B1

(12) United States Patent
Tseng

(10) Patent No.: US 6,789,452 B1
(45) **Date of Patent: *Sep. 14, 2004**

(54) INCREASED TORQUE APPLYING PLIERS

(75) Inventor: Yi Chuan Tseng, Taichung Hsien (TW)

(73) Assignee: AWI Acquisition Company, Sylmar, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/305,687

(22) Filed: Nov. 26, 2002

(51) Int. Cl.[7] ..... B25B 7/02
(52) U.S. Cl. ..... 81/311; 81/305; 81/415
(58) Field of Search ..... 81/311, 305, 312, 81/306, 415, 416; 30/191, 192

(56) References Cited

U.S. PATENT DOCUMENTS 603,975 A * 5/1898 Schmitt ..... 81/311
3,030,701 A * 4/1962 Regennitter ..... 81/312
3,680,212 A * 8/1972 Rozmus ..... 81/416
4,316,315 A * 2/1982 Vogelnik ..... 81/305
6,131,495 A * 10/2000 Chen ..... 81/423
6,257,105 B1 * 7/2001 Lin ..... 81/302
6,336,387 B1 * 1/2002 Lee ..... 81/415
6,389,626 B1 * 5/2002 Hung ..... 81/305

* cited by examiner

*Primary Examiner*—Hadi Shakeri
(74) *Attorney, Agent, or Firm*—Jack C. Munro

(57) ABSTRACT

An increased torque applying pliers which utilizes two separate sets of jaws with each set of jaws having their own pivot axis. Each set of jaws are reversely oriented relative to each other. The sets of jaws are pivotally connected together with this pivot connection also being connected to a handle assembly. The handle assembly comprises two handles which are also pivotally connected together with the pivot axis for the handle being confined within a central cavity that is formed by the jaw members. The utilizing of a separate pivot axis for the handle members which is spaced from the connecting axes that interconnect the jaw members and the handles provides for the application of an increased amount of torque when clamping of the pliers onto an exterior structure.

6 Claims, 3 Drawing Sheets

INCREASED TORQUE APPLYING PLIERS

BACKGROUND OF THE INVENTION

1. Field of the Invention

This invention relates generally to tools and more particularly to a pliers type of tool which embodies two different pair of jaws within the same tool and where the tool is constructed to apply an increased amount of torque when clamping of the tool onto an exterior structure.

2. Description of the Related Art

Hand tools, of different types, have long been known. A common form of hand tool is known as a pliers. A typical pliers has a head on which is defined a pair of jaws which can be manipulated by a pair of handles into a pincher-like action on an exterior structure. There are several different types of pliers. There is what is deemed as sharp nose or needle nose type of pliers head. There is also a pliers referred to as a snub nose type of pliers head. Tradesmen and homeowners frequently carry both type of pliers on their person or within their tool box. If both heads could somehow be incorporated within a single tool, then the tradesman or homeowner would only be required to carry a single tool rather than two different tools.

It has been known to form a combination type tool in the form of pliers where two different types of heads are incorporated within a single tool. Reference is to be had to U.S. Pat. No. 5,245,721, which shows such a combination tool. However, the combination tool of the prior art has certain deficiencies. One of these deficiencies is that there is basically a one-to-one application of force relative to the squeezing force applied to the handle. In other words, if a ten pound squeezing force is applied to the handles, then there is a ten pound gripping force applied to the structure by the jaw of the head of the tool. The reason for this is that most pliers of the prior art are constructed so that the connecting axes of the handles to the jaws are aligned with the pivot axes for the different pairs of jaws. If the connecting axes were not the same as the pivot axes, then greater leverage could be obtained, such for example, applying only five pounds of force to the handles in order to produce a ten pound clamping force onto the exterior structure. At times, a greater application of force is desirable, such as when a tradesman or homeowner is attempting to collapse a portion of a tube or in any situation where a greater amount of force is needed.

SUMMARY OF THE INVENTION

The first basic embodiment of the present invention provides for an increased torque applying pliers which utilizes a jaw assembly composed of a first pair of jaw members pivotally connected at a first pivot axis so these jaw members can move between a non-force applying position and a force applying position. The jaw assembly includes first rear extensions with one rear extension being fixed to one of the first jaw members and the other first rear extension being fixed to the other of the first jaw members. A handle assembly which comprises a first handle member and a second handle member are pivotally connected together at a handle pivot axis. The first handle member is pivotally connected to one of the first rear extensions at a first connecting axis. The second handle member is pivotally connected to the remaining first rear extension at a second connecting axis. The handle pivot axis is spaced from the first pivot axis and both the first connecting axis and the second connecting axis.

A further embodiment of the present invention is where the first basic embodiment is modified by both the first connecting axis and the second connecting axis being spaced the same distance from the handle pivot axis.

A further embodiment of the present invention is where the first basic embodiment is modified by the first pivot axis being locatable between the first rear extensions.

A further embodiment of the present invention is where the jaw assembly includes a second pair of jaw members which are reversely positioned to the first pair of jaw members.

A further embodiment of the present invention is where each jaw member of the second pair of jaw members has a rear extension which is pivotally connected to a rear extension of the first pair of jaw members.

A further embodiment of the present invention is where the just previous embodiment is modified by the first rear extensions being pivotally connected to second rear extensions with the rear extensions cooperating to form a central cavity. The first pivot axis is confined within this central cavity.

A second basic embodiment of the present invention comprises an increased torque applying pliers which comprises a first jaw pivot axis that is formed by a first jaw member that is mounted to a second jaw member that are movable between a clamping position where the first jaw member is being forced toward the second jaw member and a release position where the first jaw member is not being forced toward the second jaw member. There is a handle pivot axis which is spaced from the first jaw pivot axis with this handle pivot axis being established by interconnecting a first handle member with a second handle member. There is a first connecting axis that is formed by connecting a first handle member with a first jaw member. There is a second connecting axis that is formed by connecting a second handle with a second jaw member. The first connecting axis is spaced from the second connecting axis and also spaced from the first jaw pivot axis and also the handle pivot axis.

A further embodiment of the present invention is where the second basic embodiment is modified by the first connecting axis and the second connecting axis being spaced the same distance apart from the first jaw pivot axis.

A further embodiment of the present invention is where the second basic embodiment is modified by the handle pivot axis being locatable between a portion of the first jaw member and a portion of the second jaw member.

A further embodiment of the present invention is where the second basic embodiment is modified by there being included a third jaw member and a fourth jaw member which are also pivotally mounted together and are reversely positioned relative to the first jaw member and the second jaw member.

A further embodiment of the present invention is where the just previous embodiment is modified by the third jaw member having a rear extension and the fourth jaw member also having a rear extension with the rear extension of the third jaw member being pivotally mounted to a first jaw member and the rear extension of the fourth jaw member being pivotally mounted to a second jaw member.

A further embodiment of the present invention is where the just previous embodiment is modified by the connected together rear extensions forming a central cavity with the handle pivot axis being mounted within the central cavity.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
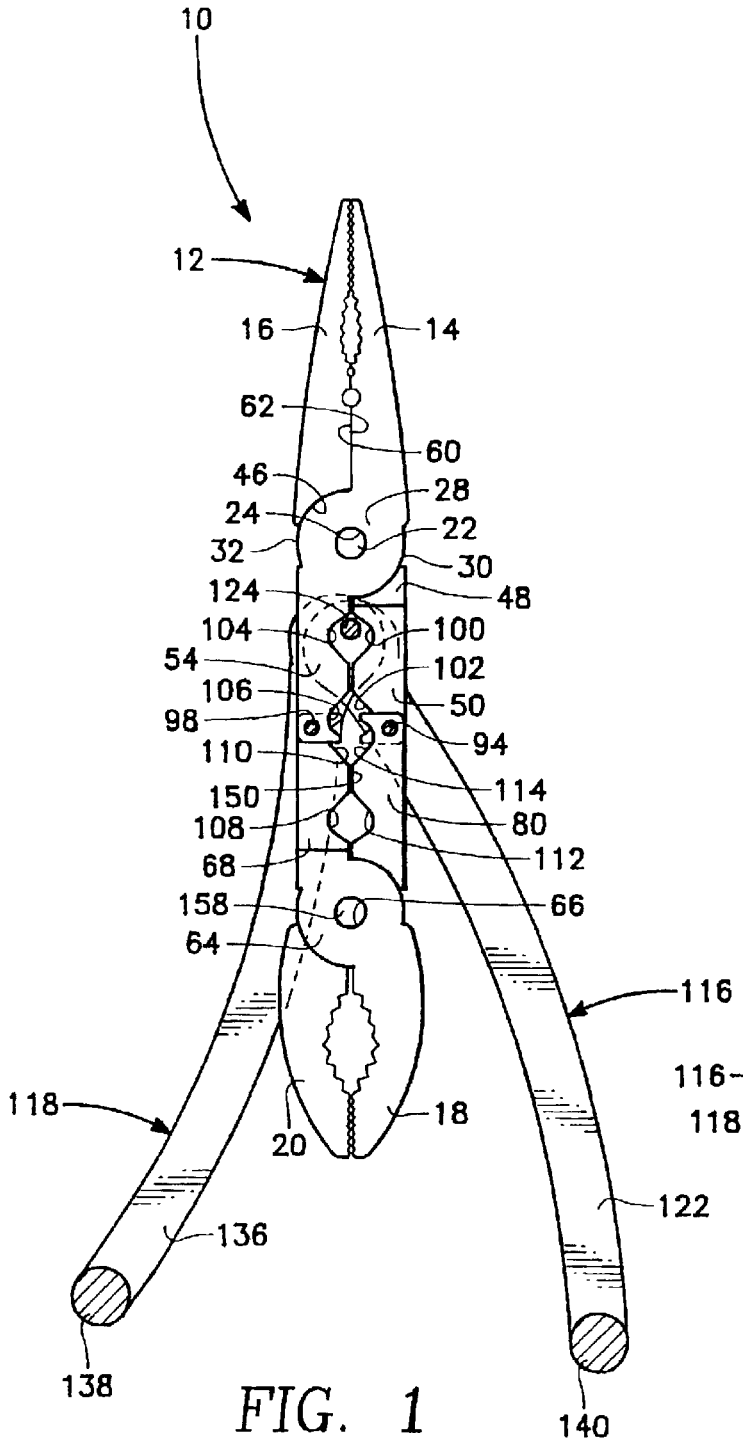
FIG. 1 is a top plan elevational view of the increased torque applying pliers of the present invention showing the pliers in a closed position where the jaw members of the pliers abut each other.
Figure 2:
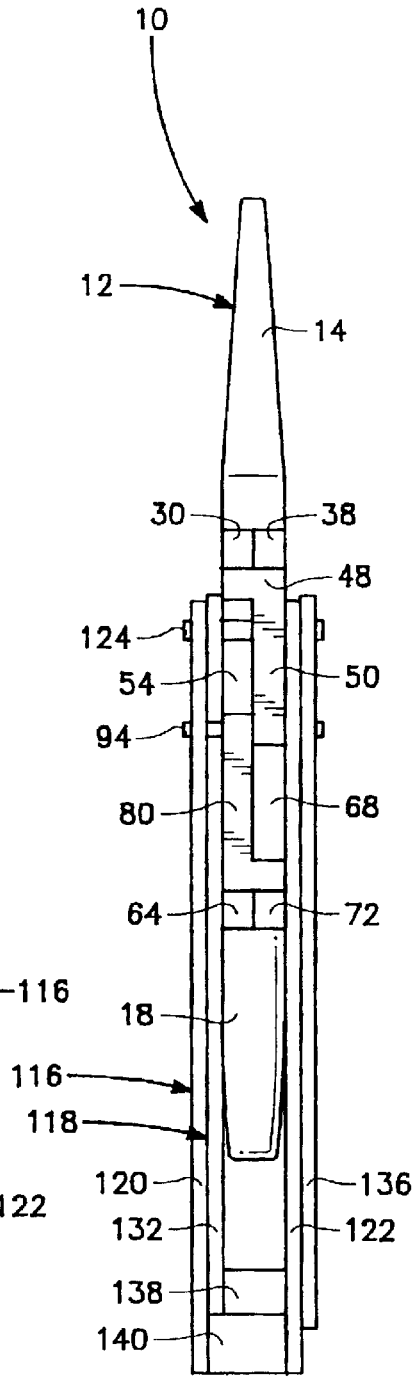
FIG. 2 is a right side elevational view of the increased torque applying pliers of the present invention.

Referring particularly to the drawings, there is shown the increased torque applying pliers 10 of this invention. Pliers 10 includes a jaw assembly 12 which is constructed of a first pair of jaw members 14 and 16 and a second pair of jaw members 18 and 20. Jaw members 14 and 16 are of a sharp pointed shape and are commonly referred to as needle nose type of pliers. Jaw members 18 and 20 are blunted in shape and are what is deemed a more conventional type of pliers. The jaw members 14 and 16 are pivotally connected together by means of a pivot pin 22 which is fitted within hole 24 of jaw member 14 and hole 26 of jaw member 16. The hole 24 is centrally mounted within a center section 28 which is basically round in configuration and has exterior cam surfaces 30 and 32 each of which are basically a segment of a circle with the surfaces 30 and 32 having the same circular center which coincides with pivot axis 34 which passes through the center of the pivot pin 22. In a similar manner, the hole 26 is mounted within a basically circular shape center section 36 which has cam surfaces 38 and 40 located on its exterior surface. The cam surfaces 38 and 40 are again of a circle whose center coincides with the pivot axis 34. The radius of the circle for the cam surfaces 38 and 40 is the same as for the cam surfaces 30 and 32.

Formed within the center section 36 is an annular groove 42. Within the annular groove 42 is to be located a spring 44. It is the function of the spring 44 to exert a continuous bias imparted to the jaw assembly 14 that tends to locate the jaw members 14 and 16 in the open position shown in FIG. 3. It is to be understood that the jaw members 14 and 16 can be clamped onto an exterior structure, which is not shown, and be in the position of FIG. 1 or be in any position where the jaw members 14 and 16 could be spread apart. For example, in FIG. 3, if an exterior object was located between the jaw members 14 and 16, the spread apart position of FIG. 3 could actually be a clamping The jaw member 16 includes a cam 46 which rides on the cam surface 32. The jaw member 16 also includes a cam 48 which rides on the cam surface 30. The jaw member 16 also includes a primary rear extension 50 which is attached to the center section 36 and extends rearwardly therefrom. Within the rear extension 50 is a hole 52. In a similar manner, the jaw member 14 has a primary rear extension 54 that is integral with the center section 28 and extends rearwardly therefrom. The rear extension 54 includes a hole 56. Cam 48 is to rest against the cam surface 30. Integral with the rear extension is a cam 58. Cam 58 is to abut against the cam surface 40. When the pliers 10 moves between the closed position of FIG. 1 and the open position of FIG. 3, the cam 48 slides on cam surface 30 and cam 58 slides on cam surface 40.

Figure 3:
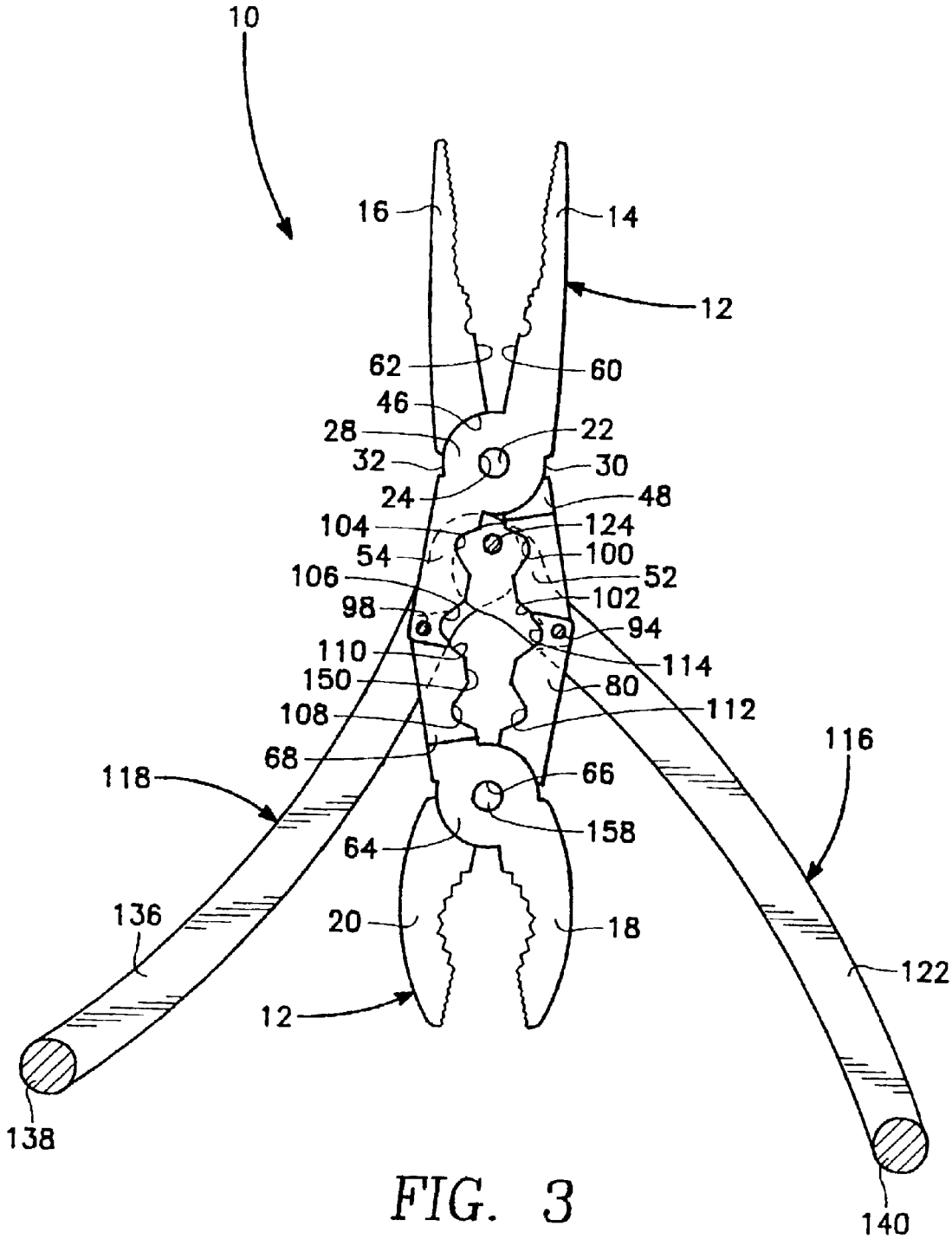
FIG. 3 is a view similar to FIG. 1 but showing the pliers in an open position.
Figure 4:
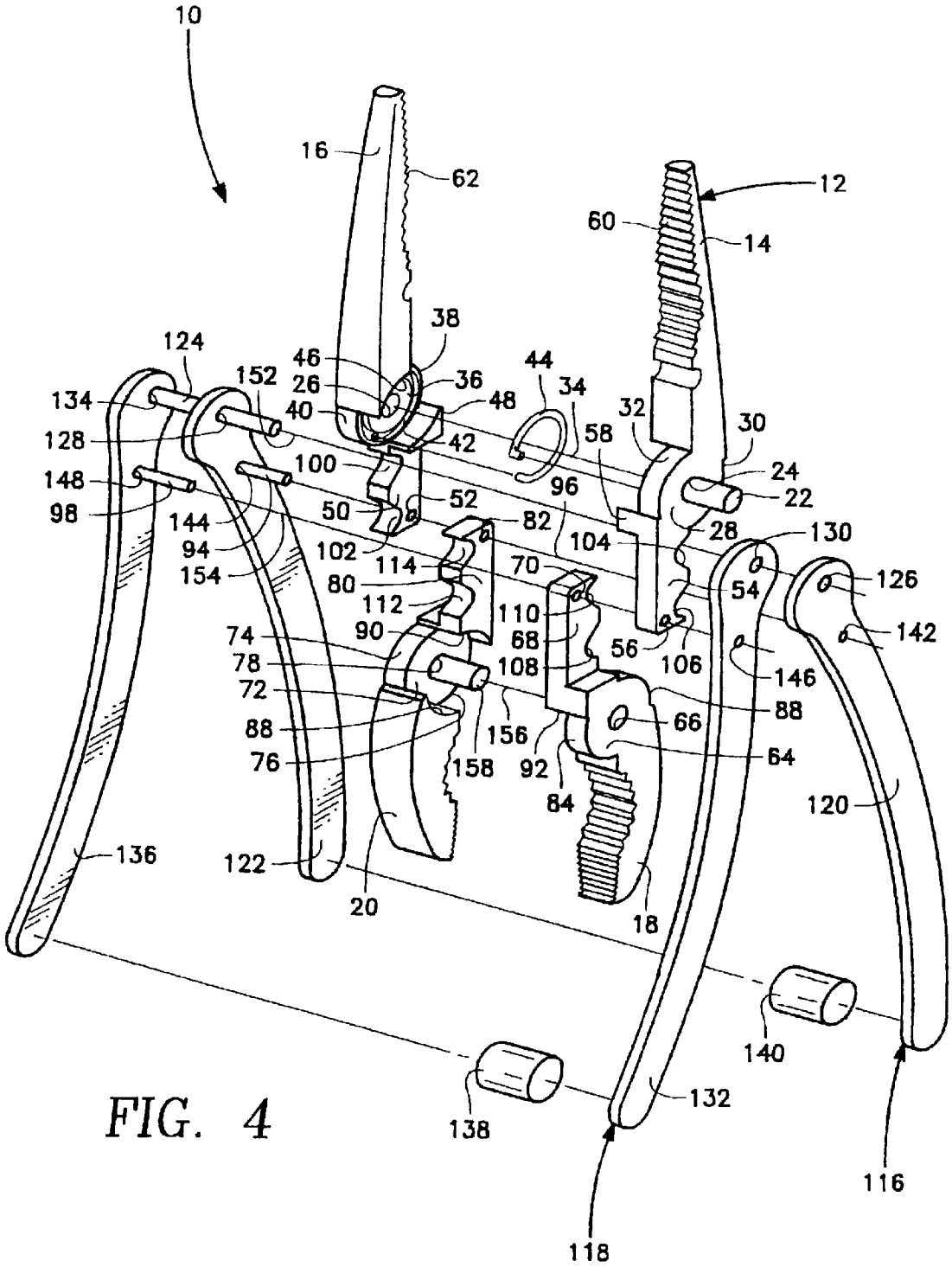
FIG. 4 is an exploded isometric view of the increased torque applying pliers of the present invention.

It can thus be seen that the jaw assembly 12, composed of jaw members 14 and 16, is pivotable so that the jaw members 14 and 16 can assume the spread apart position similar to what is shown in FIG. 3 or a closed position which is shown in FIG. 1. In the closed position of FIG. 1, the flat planar interior surfaces 60 and 62 of the respective jaw members 14 and 16 abut each other.

Jaw member 18 includes a center section 64 which is also substantially circular. The center section 64 includes a center through hole 66 integrally connected to center section 64 is a an additional rear extension 68. The rear extension 68 includes a through hole 70. The jaw member 20 includes a circular shaped center section 72. This circular shaped center section 72 has an exterior surface constructed to include a cam surface 74 and a cam surface 76. Included within the center section 72 is a centrally located through hole 78. The cam surfaces 74 and 76 are arcs of the same circle. Integrally connected to the center section 72 is a an additional rear extension 80. Rear extension 80 has a through hole 82.

The jaw members 18 and 20 are to interlock with the center sections 64 and 72 abutting one another. In this position, cam surface 84 of jaw member 18 conforms to and slides thereon the circular configuration of recess cam surface 86 of jaw member 20. The cam surface 88 on jaw member 18 similarly rides within the recessed cam surface 90 which is actually part of rear extension 80 of jaw member 20. The wall of rear extension 68, which is located directly adjacent the center section 64, is formed into a cam surface 92 which is located against cam surface 74. There is to be formed on the inside surface of the jaw member 18 a cam surface which is similar in configuration to cam surface 86 that is to ride against cam surface 76.

A connecting pin 94 connects hole 82 and hole 52. This pivotally mounts the jaw member 20 to the jaw member 16. The jaw member 20 is now capable of limited pivotal movement relative to jaw member 16 about a connecting axis 96. In a similar manner, a connecting pin 98 connects hole 70 with hole 56 with the result that jaw member 14 is pivotally mounted relative to jaw member 18.

Rear extension 50 has an inner recess 100 and an outer recess 102. Rear extension 54 also has an inner recess 104 and an outer recess 106. Rear extension 68 has a similar inner recess 108 and outer recess 110. Rear extension 80 also has a similar inner recess 112 and outer recess 114. The function of these recesses 100–114 will be explained further on the specification.

The pliers 10 of this invention includes a handle assembly in the form of a first handle member 116 and second handle member 118. The first handle member 116 is actually constructed of two separate identically shaped parts 120 and 122 which are connected together by a handle pivot pin 124. The handle pivot pin 124 is fixedly mounted within through hole 126 formed within part 120 and also within through hole 128 formed within part 122. The handle pivot pin 124 is also mounted within through hole 130 of handle part 132 of second handle member 118 and also pivotally mounted within through hole 134 of handle member 136. The handle parts 132 and 136 are assembled together forming a single unit which comprises the second handle member 118. The parts 132 and 136 are mounted together to move together as a single unit. The outer end of the handle parts 132 and 136 are fixedly secured together by a spacer pin 138. A similar spacer pin 140 fixedly mounts together the outer end of the parts 120 and 122.

The part 120 also includes a small through hole 142 into which is to be mounted the connecting pin 94. This connecting pin 94 is also mounted within a through hole 144 of the handle part 122. In a similar manner, the connecting pin 98 is mounted within a small through hole 146 formed within the handle part 132 and similarly within small through hole 148 formed within handle part 136.

It is to be noted that the jaw members 14 and 16 are reversely positioned relative to jaw members 18 and 20. Without any force applied tending to move the handle members 16 and 18 together, the spring 44 will apply a bias to the jaw assembly 12 tending to locate the jaw assembly 12 in the position shown in FIG. 3 of the drawings with the jaw members 14 and 16 being angularly spread apart and jaw members 18 and 20 being angularly spread apart. In this position, the handle pivot pin 124 is positioned very near one end of an internal cavity 150 which is formed by the connected together enclosing arrangement of the rear extensions 50, 54, 68 and 80. It is to be noted that the handle pivot pin 124 is mounted on a handle pivot axis 152 and this handle pivot axis 152 is spaced from the connecting axis 96 and the connecting axis 154 established by a connecting pin 98. The distance of the connecting axes 96 and 154 relative to the pivot axis 152 is the same and will generally comprise about five-eights of an inch. When the first handle member 116 is moved toward the second handle member 118, the jaw members 14 and 16 move closer together as well as jaw members 18 and 20 move closer together. If an exterior object was placed between the jaw members 14 and 16, a clamping action on that exterior object would occur. Although it is possible to utilize and maybe in some instances it may be convenient to utilize the jaw members 18 and 20 when in the position shown in FIG. 3, generally the position of the jaw members 18 and 20 will be deemed a storage position and a non-use position with only the jaw members 14 and 16 intending to be used. However, when it is desired to utilize jaw members 18 and 20, the user only needs to move the first handle member 116 counterclockwise approximately one-hundred and forty degrees and the second handle member 118 clockwise also about one-hundred and forty degrees. This will result in the placing of the jaw member 14 and 16 in the storage position and extend the jaw members 18 and 20 in the extended position so that such can then be readily used.

It is to be noted that because of the handle pivot axis 124 not coinciding with the pivot axis 34 or the pivot axis 156 which is formed by pivot pin 158 which is mounted within the through holes 66 and 78, additional leverage is obtained. This additional leverage is also acquired in part by the handle pivot axis 152 being spaced from the connecting axes 96 and 154. This spacing is, in essence, the obtaining of additional leverage in the same way that a lever is used with a fulcrum to where a small force could be utilized to move a much heavier object. By way of an example, a five pound force applied tending to close the handle member 116 and 118 will apply a ten pound or more clamping force between the jaw members 14 and 16 or the jaw members 18 and 20.

The reason for the recesses 110 and 104 is to provide sufficient clearance for the handle pivot pin 124 to permit the jaw assembly 12 to be moved to the closed position, as shown in FIG. 1. The same is also true for recesses 108 and 112 when the jaw members 18 and 20 are located in the extended to be used position and the jaw members 14 and 16 are in the storage position. The reason for the recesses 110 and 114 and 102 and 106 is also to provide sufficient clearance of the rear extensions 50 and 54 and the rear extensions 68 and 80 in order to achieve a completely closed position, as shown in FIG. 1.

Between the jaw members 14 and 16 and the jaw members 18 and 20 there will be formed serrated surfaces and/or cutters that are deemed to be common in constructing of pliers. The structure of this invention is making no effort to define that there is any specific novelty in the construction of these surfaces.

What is claimed is:

1. An increased torque applying pliers comprising:

a jaw assembly having a first pair of jaw members pivotally connected together at a first pivot axis so said jaw members can move between a non-force applying position and a force applying position, said jaw assembly including primary rear extensions with a first primary rear extension being fixed to one of said first jaw members and a second primary rear extension being fixed to another of said first jaw members;

a handle assembly comprising a first handle member and a second handle member which are pivotally connected together at a handle pivot axis, said first handle member being pivotally connected to a said first primary rear extension at a first connecting axis, said second handle member being pivotally connected to said second primary rear extension at a second connecting axis, said handle pivot axis being spaced from said first pivot axis and both said first connecting axis and said second connecting axis, whereby the fact that said first pivot axis is spaced from said connecting axes produces an increased value of torque to said jaw members when said jaw members are in said force applying position; and said jaw assembly comprising a second pair of jaw members pivotally connected together at a second pivot axis so said second pair of jaw members can move between a non-force applying position and a force applying position, said second pair of jaw members being reversely positioned relative to said first pair of jaw members.

2. The increased torque applying pliers as defined in claim 1 wherein:

said second pair of jaw members including additional rear extensions with one of said additional rear extensions being pivotally attached to one of said first primary rear extension and another of said additional rear extensions being pivotally attached to another of said second primary rear extension.

3. The increased torque applying pliers as defined in claim 2 wherein:

said primary rear extensions and said additional rear extensions enclosing an internal cavity, said handle pivot axis being totally confined within said internal cavity regardless of which pair of jaw members are extended and which pair are in a storage position.

4. An increased torque applying pliers which comprises:

a first jaw pivot axis that is formed by a first jaw member that is mounted to a second jaw member with both said first jaw member and said second jaw member being movable between a clamping position where said first jaw member is being forced toward said second saw member and a release position where said first jaw member is not being forced toward said second jaw member;

a handle pivot axis which is spaced from said first jaw pivot axis, said handle pivot axis is established by interconnecting a first handle member with a second handle member;

a first connecting axis that is formed by connecting said first handle member with said first jaw member, a second connecting axis formed by connecting said second handle member with said second jaw member, said first connecting axis being spaced from said second connecting axis and spaced from said jaw pivot axis and said handle pivot axis; and there being a third jaw member mounted to a fourth jaw member by being pivotally connected together at a second pivot axis so said third jaw member and said fourth jaw member can move between a non-force applying position and a force applying position, said third jaw member and said fourth jaw member being reversely positioned relative to said first jaw member and said second jaw member.

5. The increased torque applying pliers as defined in claim 4 wherein:

both said first jaw member and said second jaw member having a primary rear extension, both said third jaw member and said fourth jaw member each having an additional rear extension, each said primary rear extension being pivotally attached to a said separate said additional rear extension.

6. The increased torque applying pliers as defined in claim 5 wherein:

said rear extensions enclosing internal cavity, said first pivot axis being totally confined within said internal cavity.

* * * * *